US009808943B2

(12) United States Patent
Sato et al.

(10) Patent No.: US 9,808,943 B2
(45) Date of Patent: Nov. 7, 2017

(54) ELECTRIC SHAVER AND ITS HEAD

(71) Applicant: Panasonic Intellectual Property Management Co., Ltd., Osaka (JP)

(72) Inventors: Masaaki Sato, Shiga (JP); Hiroaki Shimizu, Shiga (JP); Toshio Ikuta, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 24 days.

(21) Appl. No.: 15/043,769

(22) Filed: Feb. 15, 2016

(65) Prior Publication Data

US 2016/0257008 A1 Sep. 8, 2016

(30) Foreign Application Priority Data

Mar. 6, 2015 (JP) ..... 2015-045164

(51) Int. Cl.
*B26B 19/04* (2006.01)

(52) U.S. Cl.
CPC ..... *B26B 19/048* (2013.01); *B26B 19/046* (2013.01)

(58) Field of Classification Search
CPC ..... B26B 19/048; B26B 19/046; B26B 19/10; B26B 19/288; B26B 19/04; B26B 19/00; B26B 19/02; B26B 19/12; B26B 19/38; B26B 19/3846; B26B 19/386
USPC .... 30/439, 43.92, 346.51, 43.91, 43.9, 34.1, 30/43.7, 43.8
See application file for complete search history.

(56) References Cited

U.S. PATENT DOCUMENTS 1,444,764 A * 2/1923 Rohde ..... B26B 21/34 30/41
2,083,580 A * 6/1937 Schmitt ..... B26B 19/3806 30/34.05
2,457,590 A * 12/1948 Mills ..... B26B 21/34 30/70
2,991,554 A * 7/1961 Somers et al. ..... B26B 19/38 116/321

(Continued)

FOREIGN PATENT DOCUMENTS

EP 1930135 6/2008
JP 2009-232894 10/2009

(Continued)

OTHER PUBLICATIONS

The Extended European Search Report dated Aug. 24, 2016 for the related European Patent Application No. 16151457.5.

*Primary Examiner* — Ghassem Alie
(74) *Attorney, Agent, or Firm* — McDermott Will & Emery LLP

(57) ABSTRACT

Head (30) of electric shaver (1) includes blade unit (40), head case (31) supporting blade unit (40), and rotary member (80) rotatably supported by head case (31). Blade unit (40) includes outer blades (51 and 61) that contact with a target area and inner blades (52 and 62) provided corresponding to outer blades (51 and 61) and configured to make a reciprocating move relative to outer blades (51 and 61). Blade unit (40) and rotary member (80) are coupled so as to move together relative to head case (31) in a height direction of head case (31). This embodiment enables the head of the electric shaver to move smoothly on the skin.

12 Claims, 9 Drawing Sheets

(56) References Cited

U.S. PATENT DOCUMENTS

| | | | | |
|---|---|---|---|---|
| 3,104,662 | A * | 9/1963 | Morawetz | A61H 23/0254 30/34.05 |
| 3,555,676 | A * | 1/1971 | Bauer | F16H 21/40 30/43.92 |
| 6,219,920 | B1 * | 4/2001 | Klein | B26B 19/048 30/346.51 |

FOREIGN PATENT DOCUMENTS

| | | |
|---|---|---|
| JP | 2013-063227 | 4/2013 |
| WO | 2013/042305 | 3/2013 |

* cited by examiner

ELECTRIC SHAVER AND ITS HEAD

BACKGROUND OF THE INVENTION

1. Field of the Invention

The present disclosure relates to an electric shaver and its head.

2. Description of the Related Art

A known head of electric shaver includes multiple blade units having an outer blade and an inner blade that makes a reciprocating move relative to the outer blade, and a head case supporting the blade units.

For example, a head disclosed in Unexamined Japanese Patent Publication No. 2009-232894 includes a rotary member rotatably disposed between adjacent blade units. The blade units and rotary member are supported by the head case such that they move separately relative to the head case in a height direction of the head case.

When this head contacts with and moves on the skin, the rotary member contacts with the skin and rotates. This reduces a friction between the blade units and skin and thus the head moves smoothly on the skin

SUMMARY OF THE DISCLOSURE

For example, if this head is applied to the skin on a protruded area, such as lower jawbone and Adam's apple, the rotary member is brought into strong contact with the skin, giving a rough touch to user. This happens due to unsmooth rotation of the rotary member. The following reasons can be predicted for this phenomenon.

Multiple blade units are disposed to sandwich the rotary member in this head. Therefore, when the head comes to a protruded area, the blade units first contact with the protruded area and then the rotary member contacts with the protruded area.

Since the rotary member contacts with the protruded area while moving in a direction different from the movement direction relative to the head case, the rotary member is hard to be moved relative to the head case. As a result, the rotary member is brought into strong contact with the protruded area, and rotational resistance of the rotary member increases. This seems to hinder the rotation of the rotary member.

An object of the present disclosure is to offer an electric shaver and its head that can be smoothly moved on the skin.

A head of an electric shaver in an exemplary embodiment of the present disclosure includes a blade unit having an outer blade that contacts with a target area and an inner blade provided corresponding to the outer blade and configured to make a reciprocating move relative to the outer blade, a head case supporting the blade unit, and a rotary member rotatably supported by the head case. The blade unit and the rotary member are coupled so as to move together relative to the head case in the height direction of the head case The exemplary embodiment enables the head of electric shaver to move smoothly on the skin.

DETAILED DESCRIPTION OF THE DISCLOSURE

Figure 1:
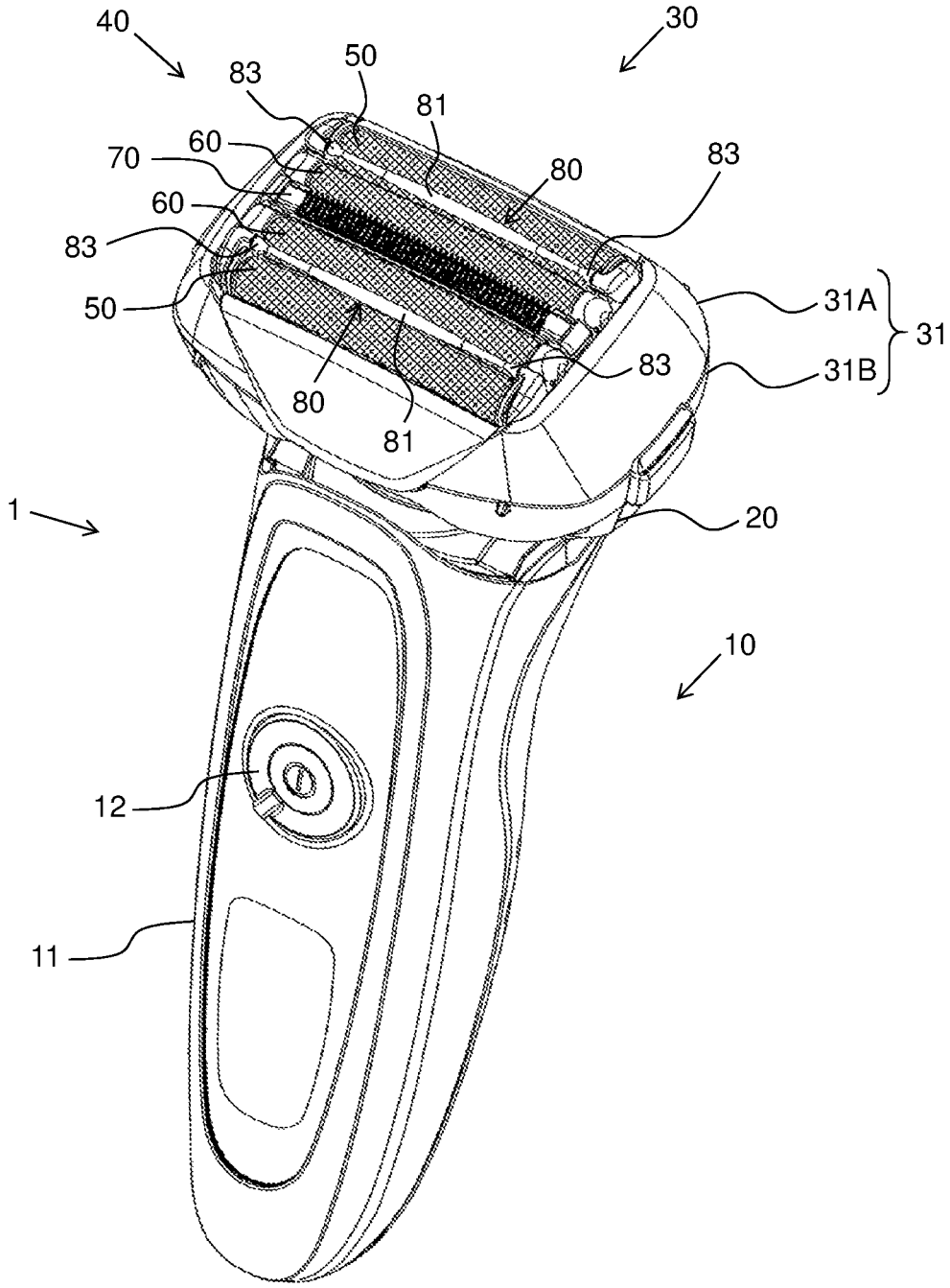
FIG. 1 is a perspective view of an electric shaver in accordance with a first exemplary embodiment of the present disclosure.

[1] A head of an electric shaver in an exemplary embodiment of the present disclosure includes a blade unit having an outer blade that contacts with a target area and an inner blade provided corresponding to the outer blade and configured to make a reciprocating move relative to the outer blade, a head case supporting the blade unit, and a rotary member rotatably supported by the head case. The blade unit and the rotary member are coupled so as to move together relative to the head case in a height direction of the head case.

When the blade unit contacts with a protruded area of the skin, such as lower jawbone and Adam's apple, the blade unit moves relative to the head case in the height direction of the head case and the rotary member moves in the height direction of the head case in accordance with the movement of the blade unit.

The exemplary embodiment avoids strong contact of the rotary member with the protruded area of the skin, and thus rotation of the rotary member is hardly obstructed. Accordingly, the head of the electric shaver can smoothly move on the skin.

[2] The head of the electric shaver in the exemplary embodiment of the present disclosure has the rotary member supported by the head case via the blade unit. This simplifies an attachment structure of the rotary member in the exemplary embodiment. Accordingly, the head is downsized to suppress an increase in manufacturing cost.

[3] The head of the electric shaver in the exemplary embodiment of the present disclosure includes multiple blade units aligned in a shorter direction of the head case. The multiple blade units include an outermost blade unit disposed on the outermost side in the alignment of the blade units. The rotary member is disposed on the inner side of the outermost blade unit in the alignment of blade units. The exemplary embodiment thus hardly hinders shaving of hair grown in a narrow area of the skin.

[4] The head of the electric shaver in the exemplary embodiment of the present disclosure has the rotary member coupled to one blade unit of adjacent blade units. The rotary member is not coupled to the other blade unit. The exemplary embodiment suppresses an increase in the number of components, compared to the rotary member coupled to both of adjacent blade units. Accordingly, the head can be downsized to suppress an increase in manufacturing cost.

[5] The head of the electric shaver in the exemplary embodiment of the present disclosure has the rotary member supported by the head case via the outermost blade unit. Since the rotary member is supported by the outermost blade unit in the exemplary embodiment, the rotary member likely contacts with the skin in both cases: When all blade units contact with the skin and when only the outermost blade unit contacts with the skin. Accordingly, the rotary member reduces friction between each blade unit and the skin.

[6] The head of the electric shaver in the exemplary embodiment of the present disclosure has the rotary member whose top is higher than the top of the outer blade in the height direction of the head case. Since the rotary member rotates as it contacts with the skin, the rotary member can reduce friction between the blade unit and skin in the exemplary embodiment.

[7] The head of the electric shaver in the exemplary embodiment of the present disclosure has the rotary member whose rotating shaft is positioned at the same height or lower than the top of the outer blade in the height direction of the head case. In the exemplary embodiment, the rotary member can be rotated more easily and hair can be cut more easily, compared to the case that the rotating shaft of the rotary member is positioned higher than the top of the outer blade in the height direction of the head case.

[8] The head of the electric shaver in the exemplary embodiment of the present disclosure has the rotary member whose diameter of a middle part is larger than a diameter of an end part. The middle part of the rotary member has more chances of contacting with the skin than the end part of the rotary member. Accordingly, the rotary member can be rotated more easily by making the diameter of the rotary member large.

The rotary member in the exemplary embodiment can thus be rotated more easily to reduce friction between the blade unit and skin.

[9] The head of the electric shaver in the exemplary embodiment of the present disclosure has the rotary member whose diameter gradually increases from the end part to the middle part. This rotary member in the exemplary embodiment can be better fitted onto the skin, and thus the rotary member can be rotated more easily on the skin. Accordingly, the head can be smoothly moved along the skin.

[10] In the head of the electric shaver in the exemplary embodiment of the present disclosure, the blade unit further includes a support case supporting the outer blade and the inner blade. The rotary member is rotatably supported by the support case. In the exemplary embodiment, the number of components can be reduced, compared to the case of supporting the rotary member with a component other than the support case. Accordingly, the head can be downsized to suppress an increase in manufacturing cost.

[11] In the head of the electric shaver in the exemplary embodiment of the present disclosure, the rotary member includes an end part inserted into the support case, and a flange formed near the end part. A diameter of the flange is gradually increased from the side of the middle part of the rotary member to the end part of the rotary member. Since the flange is formed on the rotary member in the exemplary embodiment, the flange prevents contact of the inner face of the support case with the skin. Accordingly, friction between the inner face of the support case and skin can be reduced.

[12] In the head of the electric shaver in the exemplary embodiment of the present disclosure, the rotary member is disposed on the top of the support case. The support case has a semi-cylindrical shape with a gentle slope to support the rotary member. In the exemplary embodiment, when the support contacts with the skin, the skin slides along the slope of the support, generating a soft touch on the skin.

[13] The head of the electric shaver in the exemplary embodiment of the present disclosure further includes a rotary support supported by the head case for rotatably attaching the rotary member. The rotary member is coupled to the blade unit via the rotary support. The exemplary embodiment gains practically the same effect as that in above [1].

[14] An electric shaver in an exemplary embodiment of the present disclosure has the head of the electric shaver described in one of [1] to [13]. Accordingly, the electric shaver with an effect described in one of [1] to [13] can be configured in the exemplary embodiment.

First Exemplary Embodiment

FIG. 1 is a perspective view of electric shaver 1 in the first exemplary embodiment of the present disclosure. As shown in FIG. 1, electric shaver 1 includes main body 10 having multiple components inside, head 30 for cutting hair, and head support 20 for coupling main body 10 and head 30.

Main body 10 includes grip 11 for user, power switch 12 for turning on and off the power, and a power supply unit (not illustrated) for supplying power to a drive source (not illustrated) for driving head 30. The power supply unit includes, for example, a battery or a converter for converting AC power to DC power, and a drive circuit for converting DC power from the battery or converter to AC power to drive the drive source.

Head 30 is supported by head support 20 such that head 30 can oscillate about two rotation axes. One of the two rotation axes is a rotation axis extended in a longer direction of head 30. The other is a rotation axis extended in a shorter direction of head 30. Head support 20 configures the rotation axis for oscillating head 30, typically using a four-joint link mechanism.

Figure 2:
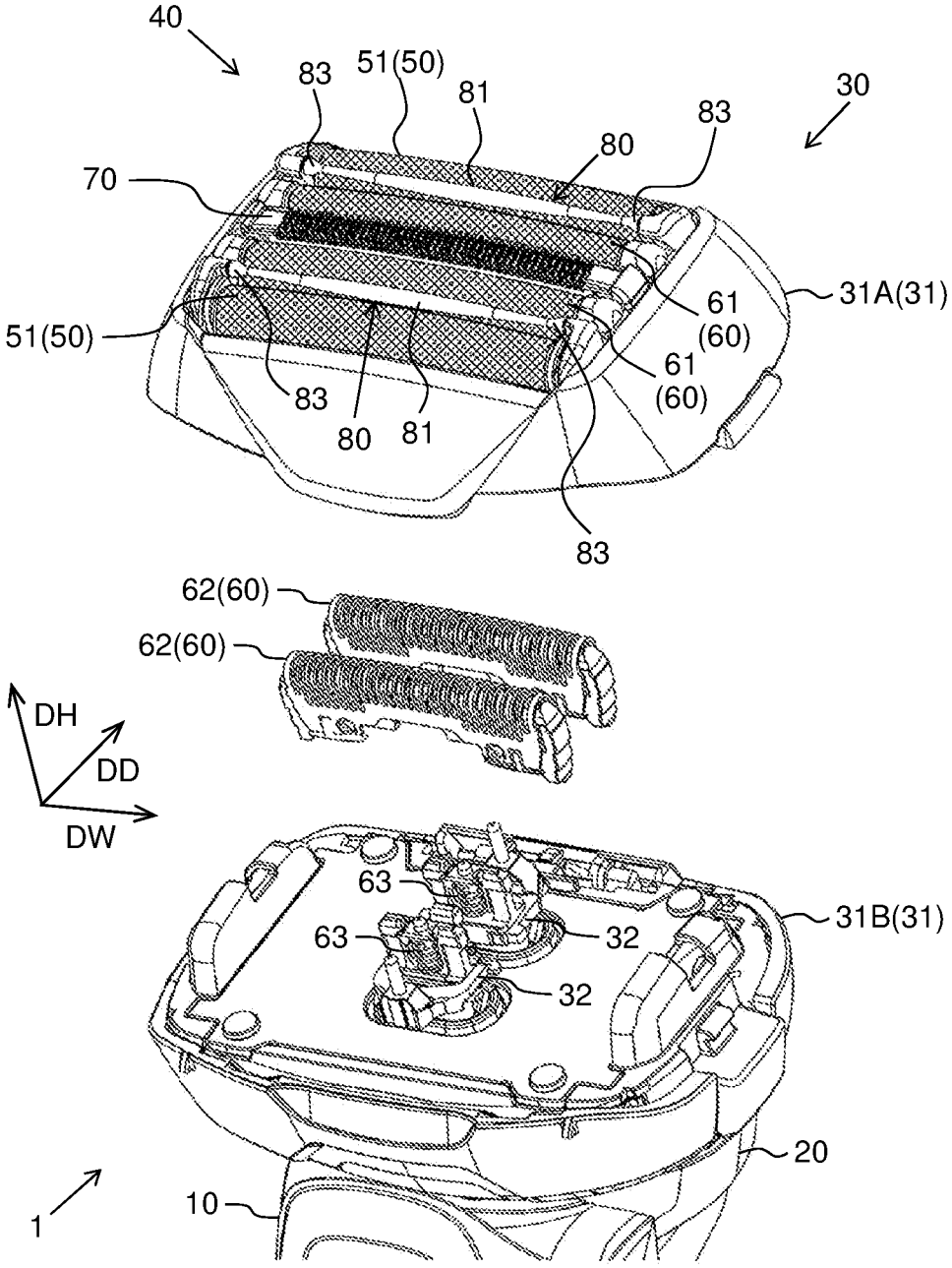
FIG. 2 is an exploded perspective view of a head of the electric shaver in accordance with the first exemplary embodiment.

FIG. 2 is an exploded perspective view of head 30. As shown in FIG. 2, head 30 includes multiple blade units 40 and head case 31.

A structure of head 30 in the exemplary embodiment show in FIG. 2 is described below, using longer direction DW of head 30 or head case 31, shorter direction DD of head 30 or head case 31 that is perpendicular to longer direction DW, and height direction DH of head 30 or head case 31.

Each blade unit 40 includes an outer blade that contacts with skin 100 (see FIG. 9), which is a target area, and an inner blade provided corresponding to the outer blade and configured to make a reciprocating move in longer direction DW relative to the outer blade. Multiple blade units 40 are aligned along shorter direction DD of head 30. Head case 31 supports multiple blade units 40.

Head 30 further includes a drive source for driving blade units 40, and multiple transmission mechanisms 32 that couple blade units 40 and the drive source, respectively. An example of the drive source is a linear motor.

Figure 3:
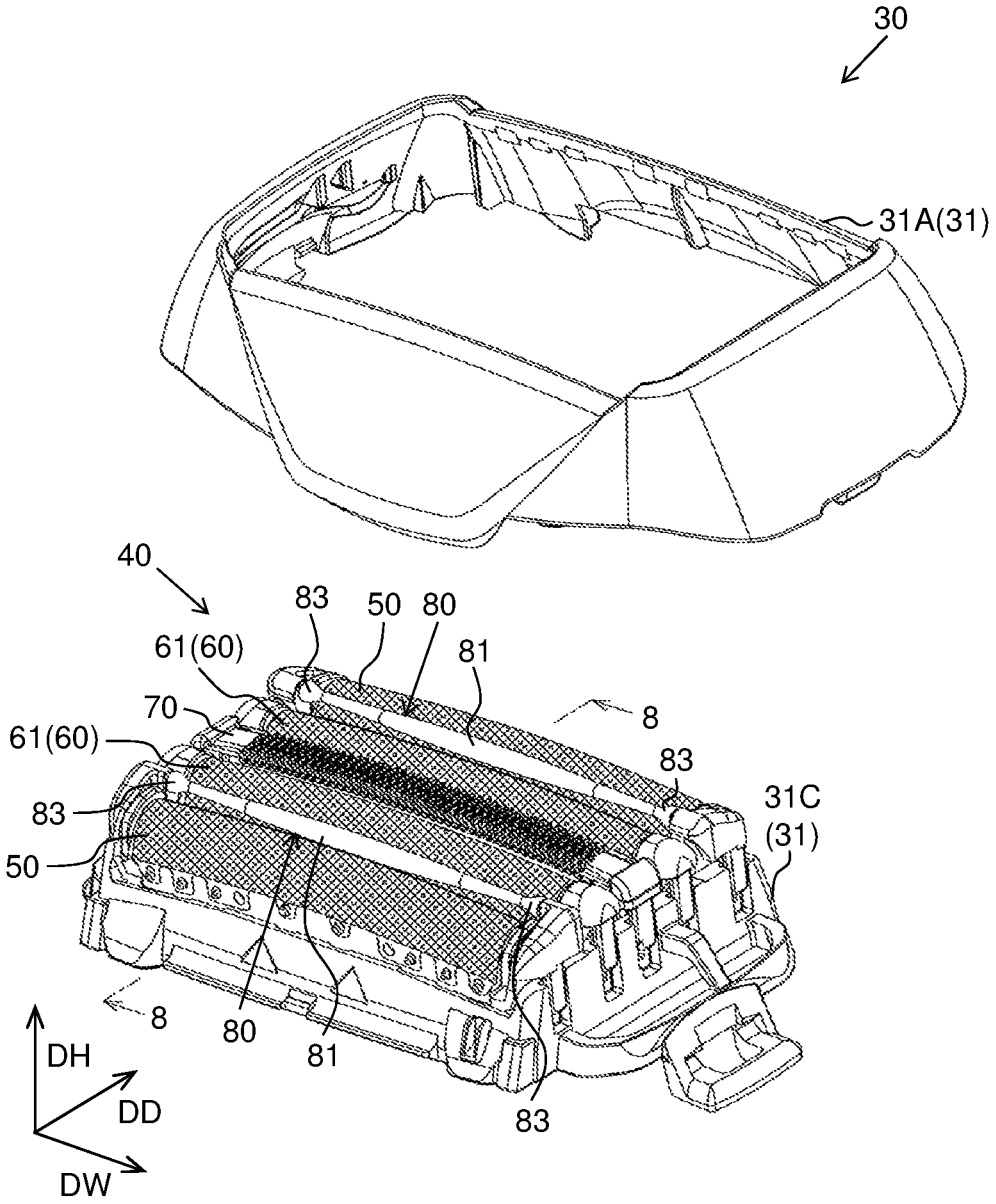
FIG. 3 is an exploded perspective view of the head in a state further exploded from the state shown in FIG. 2.
Figure 4:
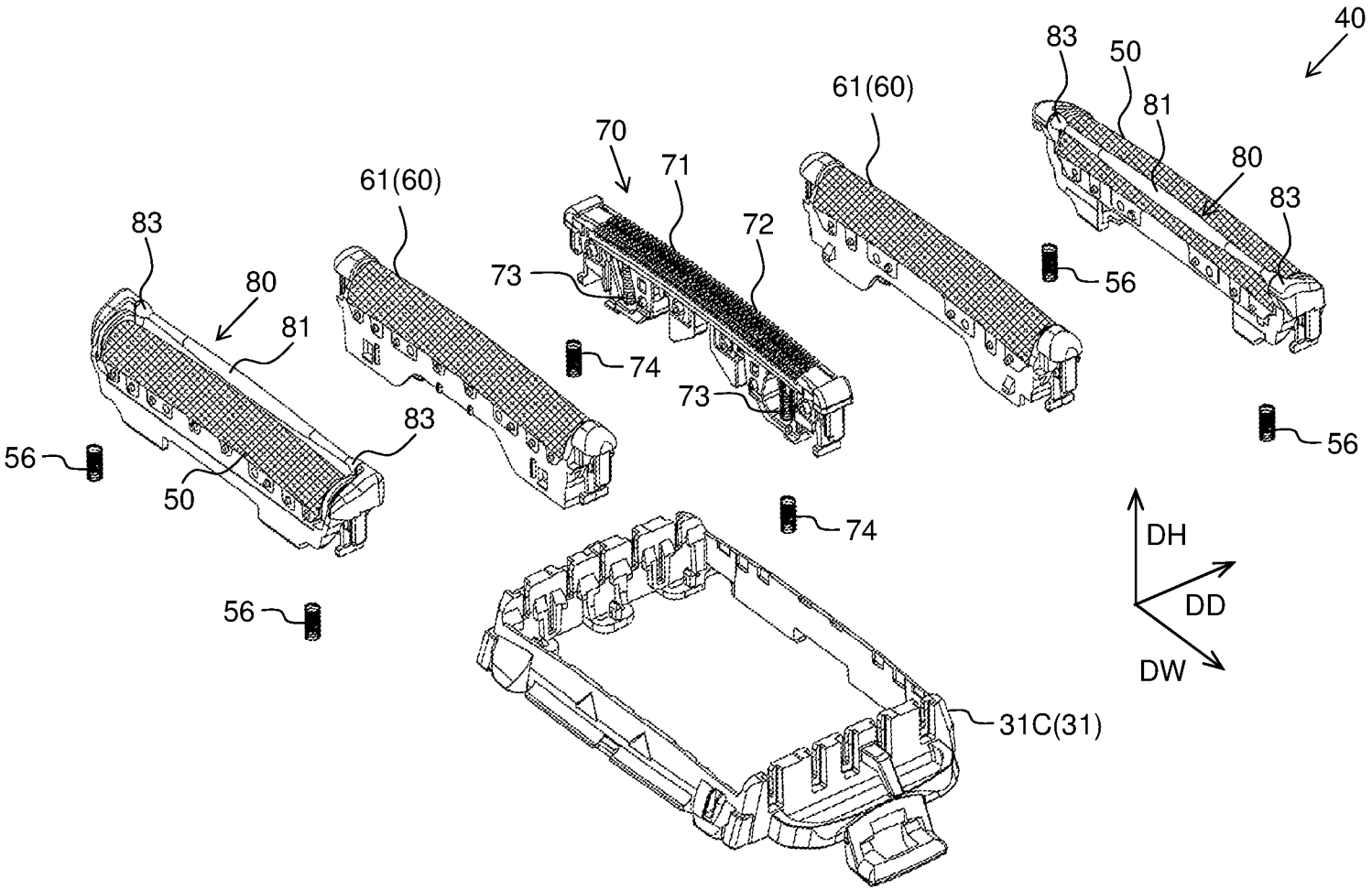
FIG. 4 is an exploded perspective view of the head in a state further exploded from the state shown in FIG. 3.
Figure 5:
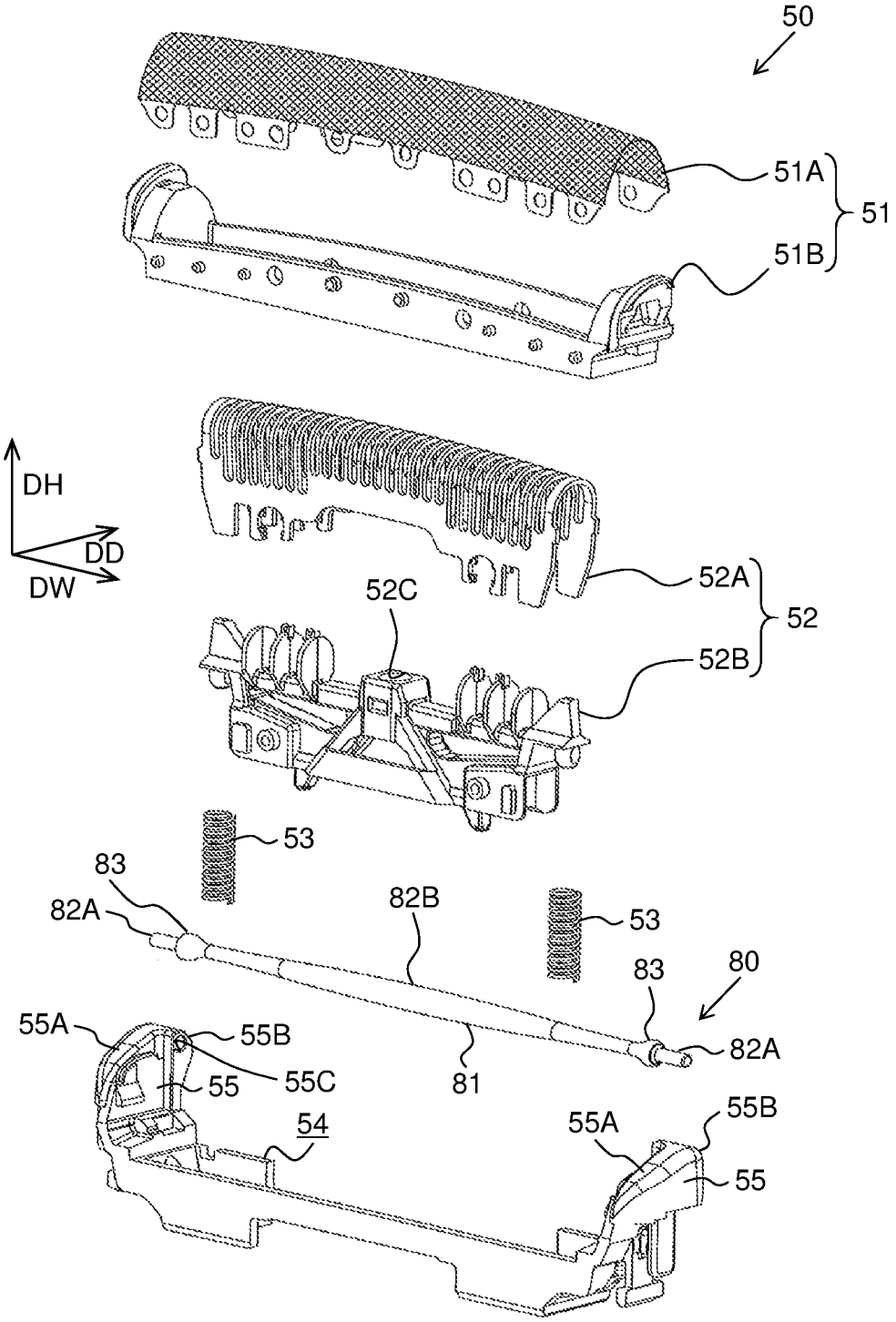
FIG. 5 is an exploded perspective view of an outermost blade unit in FIG. 4.

FIG. 3 is an exploded perspective view of head 30 in a state further exploded from the state in FIG. 2. FIG. 4 is an exploded perspective view of head 30 in a state further exploded from the state in FIG. 3. FIG. 5 is an exploded perspective view of outermost blade unit 50 in FIG. 4.

As shown in FIG. 3, head case 31 includes holding case 31C where blade units 40 are disposed, upper outer case 31A attached to holding case 31C so as to cover blade units 40, and lower outer case 31B for housing the drive source. Upper outer case 31A and holding case 31C are coupled, and upper outer case 31A and lower outer case 31B are coupled to configure head 30.

Multiple blade units 40 include a pair of outermost blade units 50 aligned in shorter direction DD, innermost blade unit 70, and a pair of middle blade units 60. The pair of outermost blade units 50 is disposed on the outer most sides in alignment of blade units 40. Innermost blade unit 70 is disposed on the innermost position in the alignment of blade units 40. The pair of middle blade units 60 is disposed between outermost blade units 50 and innermost blade unit 70, respectively.

Outermost blade units 50, middle blade units 60, and innermost blade unit 70 are attached to holding case 31C such that they move relative to head case 31 separately in height direction DH. After these blade units are attached, upper outer case 31A is fitted from above holding case 31C to couple upper outer case 31A and holding case 31C.

As shown in FIGS. 2 and 3, each of middle blade units 60 includes mesh outer blade 61 and slit inner blade 62. Outer blade 61 is supported by holding case 31C such that it moves in height direction DH relative to holding case 31C. Inner blade 62 is attached to transmission mechanism 32.

Elastic member 63 is attached to transmission mechanism 32 to provide inner blade 62 with reaction force acting in a direction toward outer blade 61. An example of elastic member 63 is a coil spring.

When a force to push middle blade unit 60 toward main body 10 is applied to its outer blade 61, middle blade unit 60 moves toward main body 10 relative to head case 31 while compressing elastic member 63. When the pushing force applied to outer blade 61 reduces, middle blade unit 60 moves to the side opposite to main body 10 relative to head case 31.

As the drive source, for example, two transmission mechanisms 32 are coupled. Each transmission mechanism 32 is protruded from lower outer case 31. Inner blade 52 (see FIG. 5) of one outermost blade unit 50, inner blade 62 of one middle blade unit 60, and inner blade 72 (see FIG. 4) of innermost blade unit 80 are attached to one transmission mechanism 32. Inner blade 52 of the other outermost blade unit 50 and inner blade 62 of the other middle blade unit 60 are attached to the other transmission mechanism 32.

When the drive source activates, each transmission mechanism 32 makes a reciprocating move in longer direction DW in opposite phases to each other. More specifically, inner blade 52 of one outermost blade unit 50, inner blade 62 of one middle blade unit 60, and inner blade 72 of innermost blade unit 70 make a reciprocating move in the same phase. Inner blade 52 of the other outermost blade unit 50 and inner blade 62 of the other middle blade unit 60 make a reciprocating move in the opposite phase.

As shown in FIG. 4, innermost blade unit 70 includes slit outer blade 71, inner blade 72, and two elastic members 73 that provide inner blade 72 with reactive force acting to move inner blade 72 toward outer blade 71. Innermost blade unit 70 is supported by holding case 31C such that innermost blade unit 70 moves relative to holding case 31C in height direction DH. An example of elastic members 73 is a coil spring.

Between innermost blade unit 70 and holding case 31C, two elastic members 74 are attached to provide innermost blade unit 70 with reactive force acting in a direction opposite to main body 10 (see FIG. 1). An example of elastic members 74 is a coil spring. Innermost blade unit 70 moves by elastic members 74 in practically the same way as middle blade unit 60.

Outermost blade unit 50 is supported by holding case 31C such that it moves relative to holding case 31C in height direction DH. Between outermost blade unit 50 and holding case 31C, two elastic members 56 are attached to provide outermost blade unit 50 with reactive force acting in a direction opposite to main body 10. An example of elastic members 56 is a coil spring. Outermost blade unit 50 moves by elastic members 56 in practically the same way as middle blade unit 60.

As shown in FIG. 5, outermost blade unit 50 includes outer blade 51 having mesh blade 51A and outer blade case 51B supporting blade 51A, and inner blade 52 having slit blade 52A and inner blade case 52B supporting blade 52A. A part of transmission mechanism 32 (see FIG. 2) is attached to attachment part 52C formed on the center of inner blade case 52B in longer direction DW. Outermost blade unit 50 further includes two elastic members 53 that provide inner blade 52 with reactive force acting in a direction toward outer blade 51, and support case 54 supporting outer blade 51, inner blade 52, and elastic members 53. An example of elastic members 53 is a coil spring.

Head 30 (see FIG. 2) further includes a pair of rotary members 80 rotatably supported by head case 31 via outermost blade units 50. In the alignment of blade units 40, rotary members 80 are disposed on the inner side of outer blades 51 of outermost blade units 50. Rotary members 80 are coupled to outermost blade units 50, but not coupled to middle blade units 60 (see FIG. 4) disposed adjacent to outermost blade units 50.

Each rotary member 80 includes roller 81 extended in longer direction DW, end parts 82A formed on both ends and inserted into support case 54, and flanges 83 formed near end parts 82A. Rotary members 80 are symmetric relative to the center line in an axial direction of the rotation axis.

A diameter of roller 81 gradually increases from end parts 82A of roller 81 to middle part 82B. In other words, a diameter of middle part 82B of roller 81 is larger than a diameter of end part 82A of roller 81.

Rotary members 80 are rotatably supported by support 55, which is the top of support case 54. Outermost blade unit 50 and rotary member 80 are coupled by fitting end parts 82A of rotary member 80 to fitting parts 55C formed on supports 55. This interlocks outermost blade unit 50 and rotary member 80 to move together relative to head case 31 in height direction DH.

Figure 6:
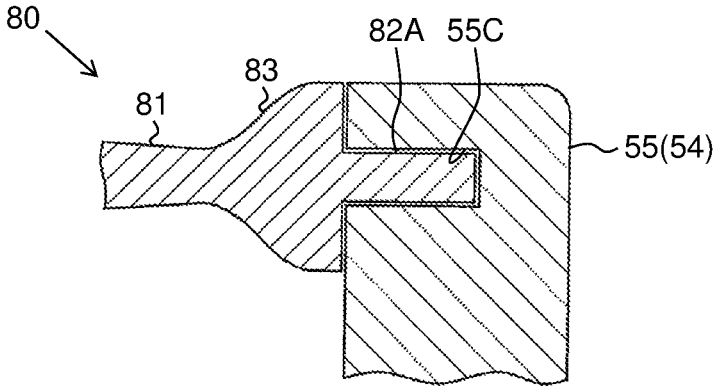
FIG. 6 is a sectional view of a flange of a rotary member and a support of a support case.
Figure 7:
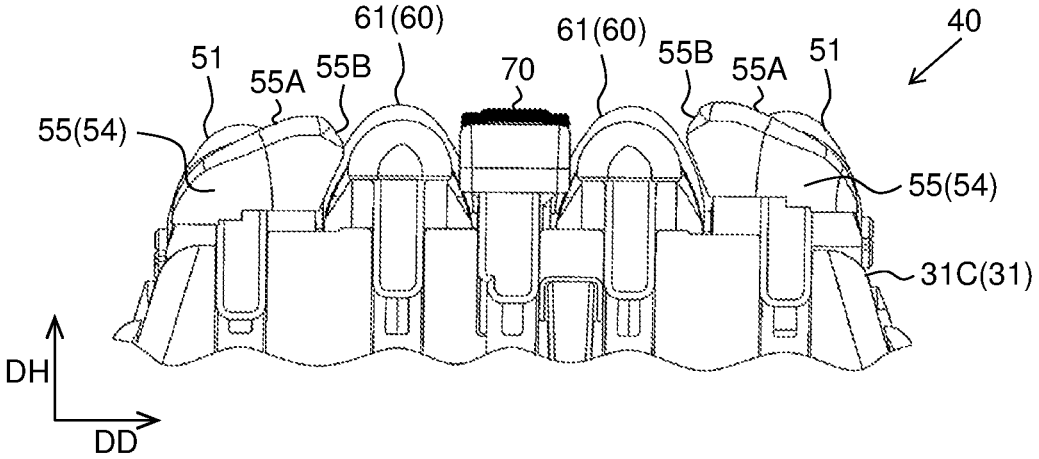
FIG. 7 is a side view of a blade unit in FIG. 3.

FIG. 6 is a sectional view illustrating fitting of flanges 83 of rotary member 80 shown in FIG. 5 and supports 55 of support cases 54. FIG. 7 is a side view of blade units 40 shown in FIG. 3 and FIG. 8 is a sectional view taken along line 8-8 in FIG. 3.

As shown in FIG. 6, each flange 83 of rotary member 80 is tapered so that its diameter gradually increases toward fitting part 55C. The top height of flange 83 is practically the same as the top height of support 55.

Figure 9:
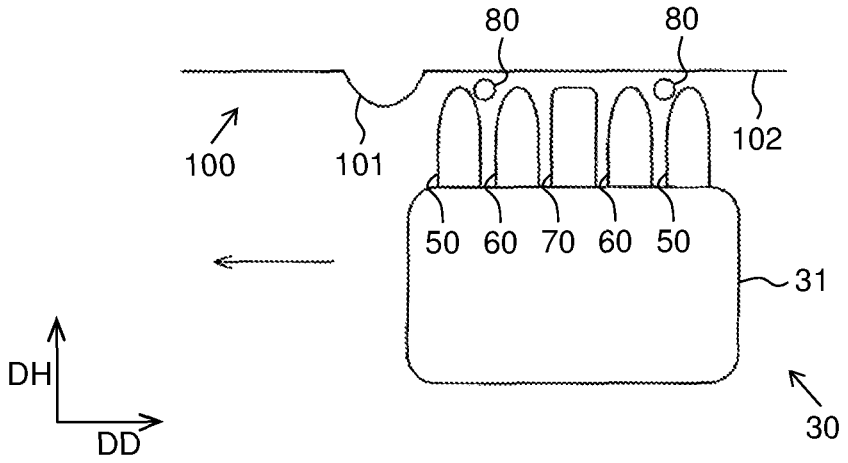
FIG. 9 illustrates a state of use of the electric shaver in accordance with the first exemplary embodiment.

As shown in FIG. 7, support 55 of support case 54 has a semi-cylindrical shape with gentle first slope 55A and second slope 55B so as to give a soft touch to skin 100 (see FIG. 9). First slope 55A is a slope from the top of support 55 toward outer blade 51 of outermost blade unit 50. Second slope 55B is a slope from the top of support 55 toward middle blade unit 60 disposed next to outermost blade unit 50.

Figure 8:
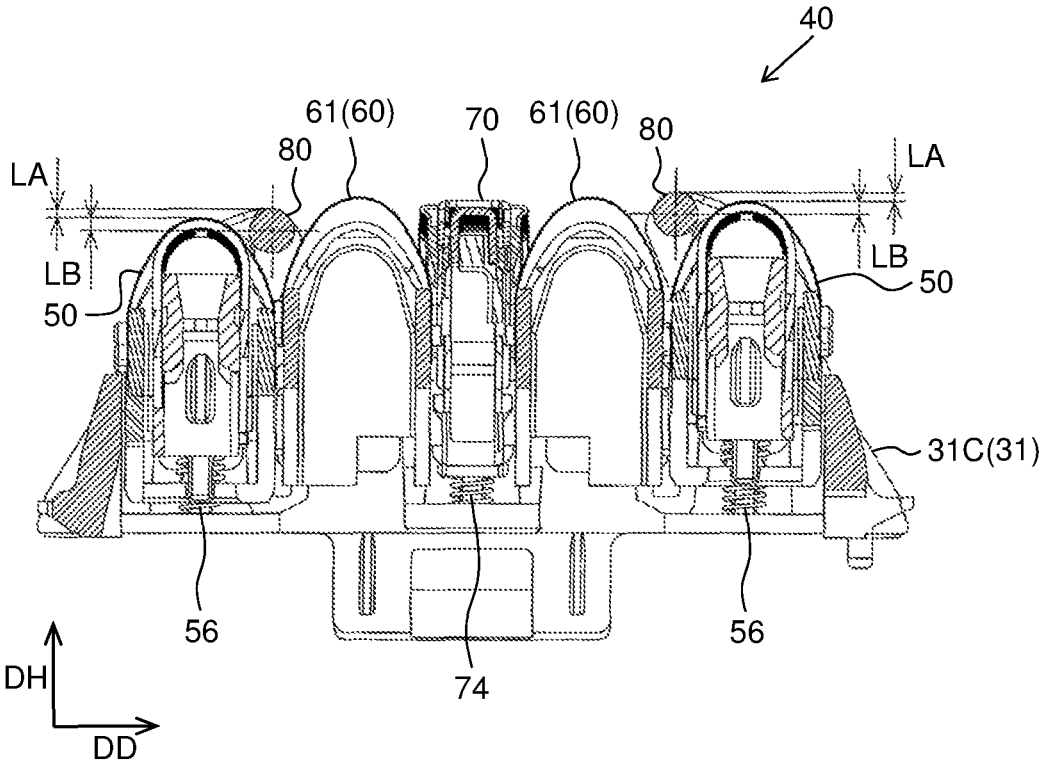
FIG. 8 is a sectional view taken along line 8-8 in FIG. 3.

As shown in FIG. 8, one outermost blade unit 50 is lower than the other outermost blade unit 50 in height direction DH. One outermost blade unit 50 is disposed to the front of electric shaver 1 in FIG. 1, i.e., the side of power switch 12 on main body 10. Rotary member 80 disposed on one outermost blade unit 50 is also lower than rotary member 80 disposed on the other outermost blade unit 50 in height direction DH.

The top of rotary member 80 is positioned higher than the top of outer blade 51 of outermost blade unit 50 in height direction DH for predetermined length LA. The rotating shaft of rotary member 80 is positioned lower than the top of outer blade 51 of outermost blade unit 50 in height direction DH for predetermined length LB. Here, length LA is shorter than length LB.

Length LA and length LB are determined by the diameter of rotary member 80 and position of rotary member 80 relative to support 55 of support case 54.

The operation of head 30 of electric shaver 1 is described below with reference to FIGS. 9 to 11.

FIG. 9 shows the state of use of electric shaver 1 in the exemplary embodiment. FIG. 10 shows a state of electric shaver 1 moved forward from the state in FIG. 9. FIG. 11 shows a state of electric shaver 1 further moved forward from the state in FIG. 10.

As shown in FIG. 9, user's skin 100 has protruded area 101, such as lower jawbone and Adam's apple, and flat area 102, such as under the chin and cheek.

Since rotary member 80 is disposed on the inner side of outer blade 51 of outermost blade unit 50 in the alignment of blade unit 40, outermost blade unit 50 contacts with protruded area 101 before rotary member 80 when head 30 is moved on flat area 102 toward protruded area 101.

Figure 10:
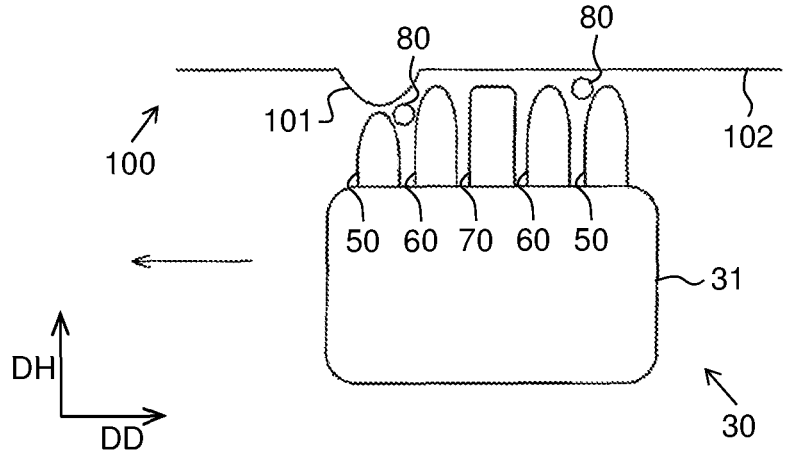
FIG. 10 illustrates a state that the electric shaver is moved forward from the state in FIG. 9.

Here, outermost blade unit 50 moves relative to head case 31 in height direction DH, as shown in FIG. 10, and then rotary member 80 also moves relative to head case 31 in accordance with the movement of blade unit 50.

When head 30 is moved on skin 100, rotary member 80 is unlikely pushed strongly against protruded area 101, and thus the rotation of rotary member 80 is unlikely obstructed. Accordingly, head 30 can smoothly move on skin 100.

Figure 11:
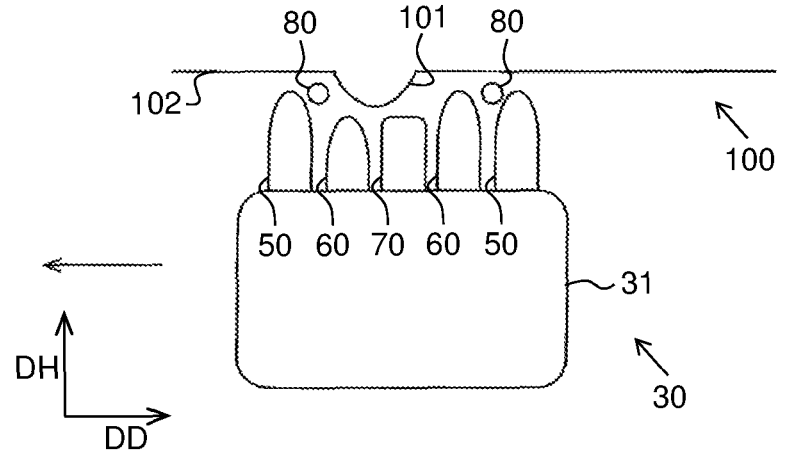
FIG. 11 illustrates a state that the electric shaver is further moved forward from the state in FIG. 10.

As head 30 is further moved toward flat area 102 and outermost blade unit 50 and rotary member 80 pass protruded area 101, the force pushing outermost blade unit 50 against main body 10 does not act any longer, as shown in FIG. 11, and outermost blade unit 50 and rotary member 80 return to their original states.

When outermost blade unit 50 contacts with skin 100, rotary member 80 also contacts with skin 100. Rotary member 80 thus reduces friction between outermost blade unit 50 and skin 10. Accordingly, head 30 can smoothly move on skin 100. By the above operation of each part of head 30, head 30 can move on skin 100 more smoothly although head 30 moves across protruded area 101 and flat portion 102 on skin 100.

The exemplary embodiment further has the following effects.

(1) The exemplary embodiment has a structure of supporting rotary member 80 by head case 31 via outermost blade unit 50. This simplifies an attachment structure of rotary member 80. As a result, head 30 can be downsized to suppress manufacturing cost.

Since outermost blade unit 50 supports rotary member 80, rotary member 80 contacts with skin 100 in both cases: When all blade units 40 contact with skin 100, and when only outermost blade unit 50 contacts with skin 100. This contact can reduce friction between blade units 40 and skin 100.

(2) Hair grown in a relatively narrow area, such as beneath the nose, is cut, for example, by outermost blade unit 50 in multiple blade units 40. Since rotary member 80 is disposed on the inner side of outer blade 51 of outermost blade unit 50 in the alignment of blade units 40 in the exemplary embodiment, rotary member 80 unlike hinders cutting of hair grown in a narrow area of skin 100.

(3) Rotary member 80 is coupled to outermost blade unit 50 but not coupled to middle blade unit 60 disposed next to outermost blade unit 50 in the exemplary embodiment. This can reduce the number of components, compared to a structure of coupling rotary member 80 to both outermost blade unit 50 and middle blade unit 60. As a result, head 30 can be downsized to suppress an increase in manufacturing cost.

(4) The top of rotary member 80 is higher than the top of outer blade 51 of outermost blade unit 50 in height direction DH in the exemplary embodiment. This facilitates contact of rotary member 80 with skin 100, and thus rotary member 80 can be rotated easily. As a result, friction between outermost blade unit 50 and skin 100 can be reduced.

(5) If outermost blade unit 50 is forced to contact with skin 100 when the rotating shaft of rotary member 80 is positioned higher than the top of outer blade 51 of outermost blade unit 50 in height direction DH, rotary member 80 is strongly pushed against skin 100, obstructing the rotation of rotary member 80. If rotary member 80 is forced to rotate in this state, contact of outermost blade unit 50 with skin 100 is insufficient, and thus hair may not be cut well.

In the exemplary embodiment, however, the rotating shaft of rotary member 80 is positioned lower than the top of outer blade 51 of outermost blade unit 50 in height direction DH. Accordingly, rotary member 80 can be rotated easily and hair can be cut easily in the exemplary embodiment.

(6) When head 30 contacts with skin 100, middle part 82B of roller 81 likely contacts with skin more than end part 82A of roller 81. In the exemplary embodiment, a diameter of middle part 82B of roller 81 is larger than a diameter of end part 82A of roller 81, and thus roller 81 can be rotated easily. Accordingly, the exemplary embodiment can reduce friction between outermost blade unit 50 and skin 100.

(7) If only the diameter of middle part 82B of roller 81 is partially large, only middle part 82B of roller 81 contacts with skin 100, and a contact area of roller 81 and skin 100 is assumed to be narrowed. In the exemplary embodiment, however, the diameter of roller 81 is gradually increased from end part 82A to middle part 82B, and thus a contact area of roller 81 and skin 100 is broadened. Roller 81 can thus rotate easily. Accordingly, the exemplary embodiment can move head 30 along the skin further smoothly.

(8) Support case 54 supporting outer blade 51 and inner blade 52 of outermost blade unit 50 also supports rotary member 80 in the exemplary embodiment. Therefore, a separate component supporting rotary member 80 is not needed in the exemplary embodiment. Accordingly, head 30 can be downsized to suppress an increase in manufacturing cost.

(9) It is assumed that friction between the inner face of support case 54 and skin 100 occurs if end part 82A of rotary member 80 and the inner face of support case 54 contact with skin 100.

In the exemplary embodiment, however, tapered flange 83 whose diameter is gradually increased from middle part 82B to end part 82A of rotary member 80 is formed near end part 82A. The top of flange 83 is practically as high as the top of support 55.

Accordingly, flange 83 prevents contact of the inner face of support case 54 with skin 100 in the exemplary embodiment, and thus no friction occurs between them.

(10) If angular support 55 is used in support case 54 and its edge contacts with skin 100, skin 100 is assumed to be stimulated. In the exemplary embodiment, however, support 55 has a semi-cylindrical shape with gentle first slope 55A and second slope 55B. Accordingly, slopes 55A and 55*b* of support 55 give a soft touch to skin 100 in the exemplary embodiment.

Second Exemplary Embodiment

The second exemplary embodiment of the present disclosure differs from the first exemplary embodiment in the following points. In other points, a structure is practically the same as that of the first exemplary embodiment. Same reference marks are given to those same as the first exemplary embodiment to omit its partial or entire description.

Figure 12:
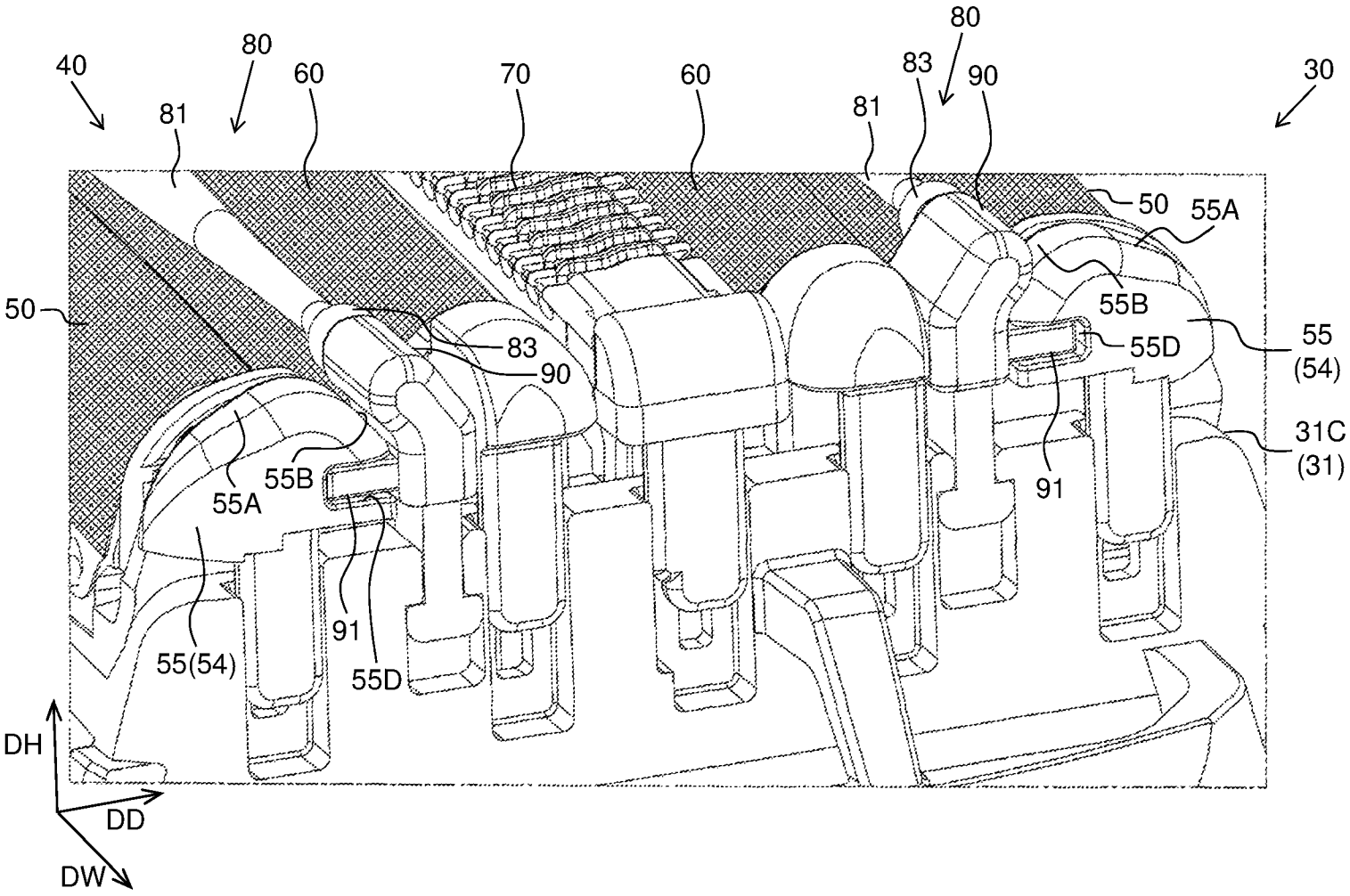
FIG. 12 is a perspective view of a blade unit of an electric shaver in accordance with a second exemplary embodiment of the present disclosure.

FIG. 12 is a perspective view of a blade unit of an electric shaver in the exemplary embodiment.

As shown in FIG. 12, head 30 further includes rotary support 90. Rotary support 90 is supported by holding case 31C, and rotatably attaches rotary member 80 to outermost blade unit 50. Holding case 31C supports rotary support 90 such that rotary support 90 moves relative to holding case 31C in height direction DH.

An elastic member (not illustrated) that provides rotary support 90 with reactive force acting in a direction opposite to main body (see FIG. 1) is attached between rotary support 90 and holding case 31C. An example of the elastic member is a coil spring.

Rotary support 90 includes rib 91 protruded to the side of outermost blade unit 50. When rib 91 is fitted into recess 55D formed in second slope 55B of support 55, rotary member 80 is coupled to outermost blade unit 50 via rotary support 90.

In the exemplary embodiment, outermost blade unit 50 and rotary member 80 are coupled so as to move together relative to head case 31 in height direction DH. The exemplary embodiment achieves practically the same effects as the first exemplary embodiment.

(Modified Embodiments)

The electric shaver and the head of the present disclosure are achievable in accordance with one of embodiments or a combination of two or more consistent embodiments described below.

As a modified embodiment of the first exemplary embodiment, rotary member 80 may be coupled also to adjacent middle blade unit 60 in addition to outermost blade unit 50. In this modified embodiment, when either outermost blade unit 50 or middle blade unit 60 moves relative to head case 31, the other and rotary member 80 move in accordance with the movement.

As a modified embodiment of the first exemplary embodiment, rotary member 80 may be supported by at least middle blade unit 60 or innermost blade unit 70, instead of outermost blade unit 50.

As a modified embodiment of the second exemplary embodiment, the elastic member attached between rotary support 90 and holding case 31C or elastic member 56 attached between outermost blade unit 50 and holding case 31C may be omitted.

As a modified embodiment of the second exemplary embodiment, rotary support 90 may be supported by upper outer case 31A so that rotary support 90 moves relative to upper outer case 31A in height direction DH.

A relationship between height of the top of flange 83 and height of the top of support 55 is arbitrarily selected. For example, the top of flange 83 may be higher than the top of support 55. This flange 83 can reduce the possibility of contact of skin 100 with the top of support 55.

A diameter of flange 83 may be uniform. In other words, flange 83 may have a cylindrical shape.

Flange 83 may be omitted and not provided.

A relationship between end part 82A of rotary member 80 and fitting part 55C of support 55 is arbitrarily selected. For example, a recess is formed on end part 82A and protrusion on fitting part 55C, and fitting part 55C may be fitted into end part 8A.

Rotary member 80 may have a cylindrical shape with uniform diameter from one end part 82A to the other end part 82A.

Diameter of roller 81 may gradually decrease from end part 82A to middle part 82B.

A relationship between length LA and length LB is arbitrarily selected. For example, length LA and length LB may be practically the same.

A positional relationship in height direction DH between the top of rotary member 80 and the top of outer blade 51 of outermost blade unit 50 is arbitrarily selected. For example, the top of rotary member 80 may practically have the same height as the top of outer blade 51 of outermost blade unit 50 in height direction DH.

A positional relationship in height direction DH between the rotating shaft of rotary member 80 and the top of outer blade 51 of outermost blade unit 50 is arbitrarily selected. For example, the rotary shaft of rotary member 80 is positioned at practically the same height as the top of outer blade 51 of outermost blade unit 50 in height direction DH.

The number of rotary members 80 is arbitrarily selected. For example, one or three or more rotary members 80 may be supported by at least one blade unit 40 in multiple blade units 40.

At least first slope 55A or second slope 55B of support 55 may be omitted. For example, a face of support 55 to the side of middle blade unit 60 may be perpendicular to the top of support 55.

Which component to use as elastic members 53, 56, 63, 73, and 74 is arbitrarily selected. For example, elastic members 53, 56, 63, 73, and 74 may be a sheet spring or disc spring.

Head case 31 to holding case 31C may be omitted. In this case, multiple blade units 40 are supported by upper outer case 31A.

The number of blade units 40 in head 30 is arbitrarily selected. For example, at least one of five blade units 40 may be omitted, or at least one blade unit 40 may be further added to five blade units 40.

In head support 20, one of two four-joint link mechanisms for oscillating head 30 about two rotating shafts may be omitted.

To improve the following capability of head 30 on skin 100, a structure for moving head 30 relative to main body 10 in height direction DH may be further provided.

The electric shaver and its head of the present disclosure are also applicable to, for example, an epilator and depilatory device.

What is claimed is:

1. A head of an electric shaver, comprising:

a plurality of blade units, each including an outer blade that contacts with a target area and an inner blade provided corresponding to the outer blade and configured to make a reciprocating move relative to the outer blade;

a head case supporting the plurality of blade units; and a first rotary member rotatably supported by the head case, wherein:

the plurality of blade units are aligned in a shorter direction of the head case and includes a first outermost blade unit disposed on one of outermost sides in an alignment direction of the plurality of blade units, the first rotary member is disposed outside the outer blade of the first outermost blade unit and supported by the first outermost blade unit, the first outermost blade unit and the first rotary member are coupled so as to move together relative to the head case in a height direction of the head case, and the first rotary member is not coupled to one of the plurality of blade units adjacent to the first outermost blade unit.

2. The head of the electric shaver of claim 1, wherein the first rotary member is disposed on an inner side of the first outermost blade unit in the alignment direction of the plurality of blade units.

3. The head of the electric shaver of claim 2, wherein:

the first outermost blade unit further includes a support case supporting the outer blade and the inner blade, and the support case rotatably supports the first rotary member.

4. The head of the electric shaver of claim 3, wherein:

the first rotary member includes an end part to be inserted into the support case and a flange formed near the end part, and a diameter of the flange gradually increases from a middle part of the first rotary member to an end part of the first rotary member.

5. The head of the electric shaver of claim 3, wherein:

the first rotary member is disposed on a top of the support case, and the support case has a semi-cylindrical support with a gentle slope to support the first rotary member.

6. The head of the electric shaver of claim 1, wherein a top of the first rotary member is higher than a top of the outer blade of the first outermost blade unit in the height direction.

7. The head of the electric shaver of claim 6, wherein a rotating shaft of the first rotary member is positioned at a height not greater than the top of the outer blade of the first outermost blade unit in the height direction.

8. The head of the electric shaver of claim 1, wherein a diameter of a middle part of the first rotary member is larger than a diameter of an end part of the first rotary member.

9. The head of the electric shaver of claim 8, wherein a diameter of the first rotary member gradually increases from the end part to the middle part.

10. The head of the electric shaver of claim 1, further comprising a rotary support supported by the head case and rotatably attaching the first rotary member, wherein the first rotary member is coupled to the first outermost blade unit via the rotary support.

11. An electric shaver equipped with the head of the electric shaver of claim 1.

12. The head of the electric shaver of claim 1, wherein:

the plurality of blade units further includes a second outermost blade unit disposed on another of the outermost sides in the alignment direction of the plurality of blade units, a second rotary member is disposed outside the outer blade of the second outermost blade unit and supported by the second outermost blade unit, the second outermost blade unit and the second rotary member are coupled so as to move together relative to the head case in the height direction of the head case, and the second rotary member is not coupled to one of the plurality of blade units adjacent to the second outermost blade unit.

* * * * *